US011661938B2

(12) United States Patent
Parrish et al.

(10) Patent No.: US 11,661,938 B2
(45) Date of Patent: May 30, 2023

(54) PUMP SYSTEM AND METHOD FOR OPTIMIZED TORQUE REQUIREMENTS AND VOLUMETRIC EFFICIENCIES

(71) Applicants: GM GLOBAL TECHNOLOGY OPERATIONS LLC, Detroit, MI (US); GHSP, Inc., Holland, MI (US); GKN Sinter Metals LLC, Auburn Hills, MI (US)

(72) Inventors: Robert Benson Parrish, White Lake, MI (US); Michael P Fannin, Brighton, MI (US); Avinash Singh, Sterling Heights, MI (US); Ryan David Rosinski, Whitehall, MI (US); Alan Clifford Taylor, Lake Orion, MI (US); Thomas John Fonville, Denver, NC (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 25 days.

(21) Appl. No.: 17/446,530

(22) Filed: Aug. 31, 2021

(65) Prior Publication Data

US 2023/0062955 A1 Mar. 2, 2023

(51) Int. Cl.
*F03C 2/00* (2006.01)
*F03C 4/00* (2006.01)
(Continued)

(52) U.S. Cl.
CPC ..... *F04C 2/103* (2013.01); *F04C 15/0026* (2013.01); *F04C 18/10* (2013.01);
(Continued)

(58) Field of Classification Search
CPC ..... F04C 2/103; F04C 15/0026; F04C 18/10; F04C 27/006; F04C 2230/60;
(Continued)

(56) References Cited

U.S. PATENT DOCUMENTS 5,338,168 A * 8/1994 Kondoh ..... F04C 2/082 418/179
6,089,843 A * 7/2000 Kondoh ..... F04C 2/086 418/179
(Continued)

FOREIGN PATENT DOCUMENTS

JP 2001207974 A * 8/2001 ..... F04C 2/10

OTHER PUBLICATIONS

JP-2001207974-A—Sagara et al.—Oil Pump—Aug. 3, 2001—copy the Machine English Translation (Year: 2001).*

*Primary Examiner* — Theresa Trieu
(74) *Attorney, Agent, or Firm* — Lorenz & Kopf LLP

(57) ABSTRACT

Systems and methods are provided for pumps that deliver optimized torque characteristics and volumetric efficiency. A system includes a housing defining a surface and a rotor defining a face. A face clearance is defined between the face and the surface. The face clearance is variable in magnitude and determinative of target performance characteristics of the pump system. The housing is made of a material selected to have a thermal expansion characteristic and the rotor is made of a second material selected to have another thermal expansion characteristic. The thermal expansion characteristics deliver the target performance characteristics of the pump system.

20 Claims, 5 Drawing Sheets

(51) Int. Cl.

| | |
|---|---|
| ***F04C 18/00*** | (2006.01) |
| ***F04C 2/00*** | (2006.01) |
| ***F04C 2/10*** | (2006.01) |
| ***F04C 18/10*** | (2006.01) |
| ***F04C 27/00*** | (2006.01) |
| ***F04C 15/00*** | (2006.01) |

(52) U.S. Cl.
CPC ..... *F04C 27/006* (2013.01); *F04C 2230/60* (2013.01); *F04C 2240/10* (2013.01); *F04C 2240/20* (2013.01)

(58) Field of Classification Search
CPC ..... F04C 2230/602; F04C 2230/90; F04C 2230/92; F04C 2240/10; F04C 2240/20; F04C 2240/30
See application file for complete search history.

(56) References Cited

U.S. PATENT DOCUMENTS

| | | | | |
|---|---|---|---|---|
| 2005/0063851 | A1* | 3/2005 | Phillips | F04C 2/084 418/61.3 |
| 2010/0239449 | A1* | 9/2010 | Bachmann | F04C 2/102 418/166 |
| 2014/0154125 | A1* | 6/2014 | Blechschmidt | F04C 15/0026 418/61.3 |
| 2015/0017049 | A1* | 1/2015 | Naiki | F04C 11/001 418/205 |
| 2015/0357886 | A1* | 12/2015 | Ishizeki | H02K 11/33 310/71 |
| 2022/0010874 | A1* | 1/2022 | Parrish | F04C 2/084 |

* cited by examiner

PUMP SYSTEM AND METHOD FOR OPTIMIZED TORQUE REQUIREMENTS AND VOLUMETRIC EFFICIENCIES

INTRODUCTION

The present disclosure generally relates to the field of pump systems and more specifically, to pump systems providing desired and tunable performance characteristics by leveraging thermal expansion rates.

Pump systems of apparatus such as vehicles and other equipment and machinery, move fluids and/or generate pressures for a variety of purposes. Many types of pumps are available and each generally requires a motive input device (motor), such as one that operates on electric, pneumatic, hydraulic, or mechanical power to drive moving parts of the pump. The design and operating conditions of the pump determine the amounts of torque or force required to drive the moving parts. The amount of torque/force required influences the cost, weight and type of the motive input device that is appropriate for use. Characteristics of pumps include the relationship between the volume, flow and the pressure at different driving speeds, the relationship between the output pressure and flow and the provided input energy (such as torque or force), and the actual amount of fluid flowing through a pump, rather than its theoretical maximum (volumetric efficiency). Volumetric efficiency may also be described as a measure of volumetric losses, such as through internal leakage and fluid compression.

The torque/force requirements for driving a pump, determine the size and cost of the motive input device coupled with the pump. The pump's volumetric efficiency has an impact on the size of the pump that will achieve performance requirements for a given application. In applications such as those for vehicles, size and its impact on weight may have an influence on factors such as fuel economy. As a result, in designing pump systems, the torque/force requirements and the volumetric efficiencies, along with other factors, are taken into consideration.

Accordingly, it is desirable to provide a pump system for a given application that results in appropriate performance characteristics such as torque/force requirements and volumetric efficiencies. Furthermore, other desirable features and characteristics of the present invention will become apparent from the subsequent detailed description and the appended claims, taken in conjunction with the accompanying drawings and the foregoing technical field and background.

SUMMARY

Systems and methods are provided for pump systems that deliver desirable performance characteristics at prescribed conditions. In various embodiments, a pump system includes a housing defining a surface and a rotor defining a face. A face clearance is defined between the face and the surface. The face clearance is variable in magnitude and determinative of target performance characteristics of the pump system. The housing is made of a material selected to have a thermal expansion characteristic and the rotor is made of a second material selected to have another thermal expansion characteristic. The thermal expansion characteristics deliver the target performance characteristics of the pump system.

In additional embodiments, the thermal expansion characteristics deliver a greater expansion of the rotor than that of the housing, in response to temperature increases.

In additional embodiments, one of the materials is steel and the other material is aluminum.

In additional embodiments, the thermal expansion characteristics result in opening the face clearance as temperature decreases and closing the face clearance as temperature increases.

In additional embodiments, the thermal expansion characteristics provide a matched expansion of the rotor and with that of the housing in response to temperature increases, maintaining the face clearance at a consistent value.

In additional embodiments, a motor is coupled with the rotor. The thermal expansion characteristics deliver a targeted increase of the face clearance as temperature decreases, minimizing torque requirements of the motor.

In additional embodiments, the thermal expansion characteristics are selected to target maximization of the volumetric efficiency of the pump system as temperature increases.

In additional embodiments, an electric motor is coupled with the rotor, and power electronics are coupled with the electric motor. The thermal expansion characteristics are selected to minimize size of the electric motor.

In additional embodiments, the rotor comprises a gerotor, and an idler surrounds the gerotor.

In additional embodiments, the housing defines a cavity, with the rotor disposed in the cavity. The cavity is closed by a cover defining another surface, and the rotor includes the face, which faces the surface of the housing and includes another face facing the other surface. Gaps are defined between respective faces and the surfaces of the housing. The face clearance is a sum of the two gaps.

In various other embodiments, a method includes constructing a pump with a housing defining a surface. A rotor is assembled in the pump, with the rotor defining a face. A face clearance is defined between the face and the surface, with the face clearance being variable in magnitude. Based on the face clearance, target performance characteristics of the pump system are determined. A material is selected for the housing that has a thermal expansion characteristic. A material is selected for the rotor and also has a thermal expansion characteristic. The two thermal expansion characteristics deliver the target performance characteristics of the pump system.

In additional embodiments, the thermal expansion characteristics deliver a greater expansion of the rotor than that of the housing, in response to temperature increases.

In additional embodiments, steel is selected as the material for the housing and aluminum is selected as the material for the rotor.

In additional embodiments, the thermal expansion characteristics result in opening the face clearance as temperature decreases, and in closing the face clearance as temperature increases.

In additional embodiments, matching, based on the thermal expansion characteristics deliver a matched expansion of the rotor with that of the housing in response to temperature increases, maintaining the face clearance at a consistent value.

In additional embodiments, a motor is coupled with the rotor. The thermal expansion characteristics target increase of the face clearance as temperature decreases to minimize torque requirements of the motor.

In additional embodiments, the thermal expansion characteristics target maximization of the volumetric efficiency of the pump system as temperature increases.

In additional embodiments, an electric motor is coupled with the rotor and power electronics are coupled with the electric motor. The thermal expansion characteristics are selected to minimize size of the electric motor.

In additional embodiments, a range of materials are considered to deliver the target performance characteristics. The materials that best deliver minimized torque requirements at lowered temperatures and maximized volumetric efficiency at increased temperatures are selected. The selected materials are tuned by altering their thermal expansion characteristics to deliver a desirable magnitude of the face clearance at select temperatures.

In various additional embodiments, a housing defines a surface, a rotor defines a face, and a face clearance is defined between the face and the surface. The face clearance is variable in magnitude and is determinative of desired target performance characteristics of the pump system. A motor is coupled with the rotor. The housing is made of a material selected to have a desired thermal expansion characteristic, and the rotor is made of a material selected to have another thermal expansion characteristic. The first thermal expansion characteristics deliver a greater expansion of the rotor as compared to that of the housing under increasing temperatures. The expansions deliver minimized torque requirements of the motor at decreasing temperatures and maximized volumetric efficiency of the pump system under increasing temperatures.

BRIEF DESCRIPTION OF THE DRAWINGS

The exemplary embodiments will hereinafter be described in conjunction with the following drawing figures, wherein like numerals denote like elements, and wherein.

DETAILED DESCRIPTION

Figure 1:
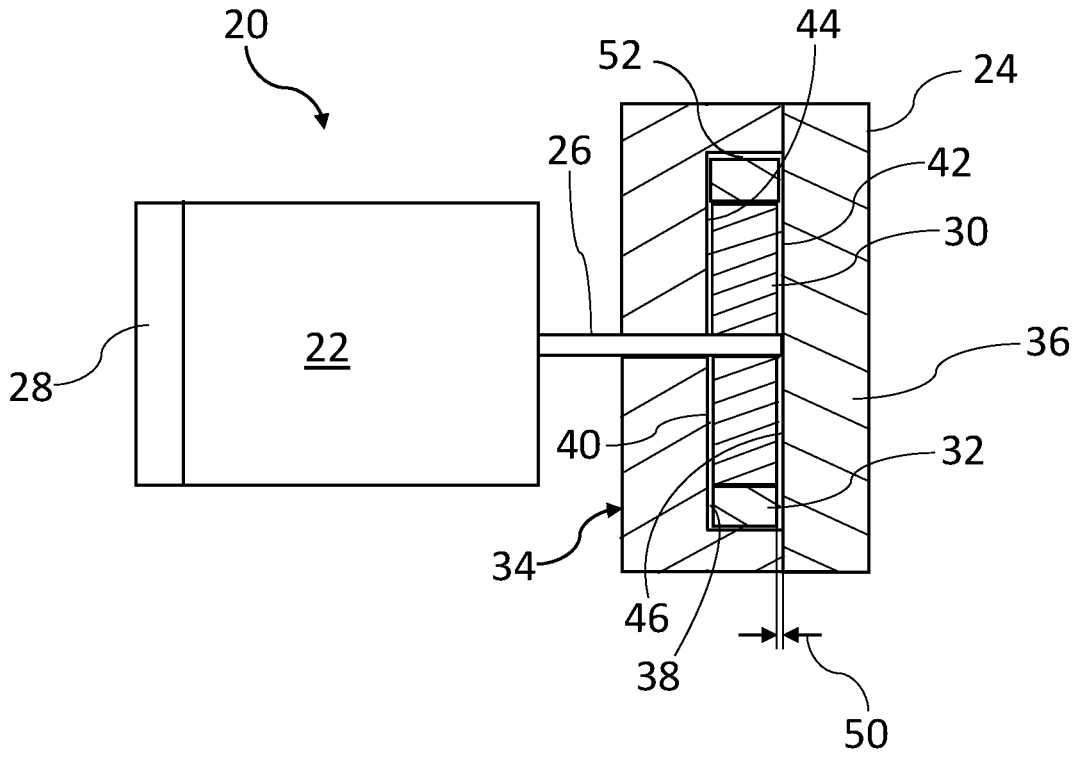
FIG. 1 is a schematic illustration of a pump system, in accordance with various embodiments.

The following detailed description is merely exemplary in nature and is not intended to limit the application and uses. Furthermore, there is no intention to be bound by any expressed or implied theory presented in the preceding introduction, brief summary or the following detailed description.

As disclosed herein, pump systems are provided that deliver desirable performance characteristics over a substantial range of operating temperatures by leveraging the thermal expansion characteristic of different components of the system. For example, in a system with an internal gear type pump, the stationary housing of the pump is made with one material and the moving rotor of the pump is made from a different material. The two materials are selected and tuned to have specific thermal responses that result in desirable performance characteristics. For example, the housing material is selected to have a relatively low coefficient of thermal expansion and the rotor material is selected to have a relatively high coefficient of thermal expansion. In one embodiment, the coefficient of thermal expansion of the rotor material is approximately twice that of the housing material. The result is tailorable such as to achieve low torque requirements at colder temperatures and simultaneously to achieve high volumetric efficiencies at hotter temperatures. In embodiments, the outcomes are a result of managing clearances, such as the running face clearance, over a wide temperature range.

In an exemplary application, a pump system may operate under conditions that range widely, such as from negative forty degrees Celsius to one-hundred-twenty-five degrees Celsius. Such applications include vehicle system pumps that are exposed to ambient temperatures in diverse environments and where fluid heating may result from the work being done by the pump system. Managing the running face clearance for cold temperature operation results in minimized input torque requirements, including start-up torque, enabling the use of a relatively small motor. Managing the running face clearance for hot temperature operation results in maximized volumetric efficiency enabling the use of a relatively small pump both physically and in terms of displacement for a given application than would otherwise be possible. The results include minimized energy input and consumption needed to drive the pump system.

In various embodiments, a pump system is configured to move a fluid/generate a pressure through at least two components parts that move relative to each other, such as a rotor and a housing. Relative movement of the parts requires clearance, which is sized to account for part build variation within tolerance ranges, to account for the nature of the fluid being worked, and for temperature variations. One component part has a coefficient of thermal expansion tailored to have a first level of expansion and the other component part has a coefficient of thermal expansion tailored to have a second level of expansion, where both levels of expansion are tailored to achieve performance characteristics such as motive power input and volumetric efficiencies desirable for the application over the applicable range of operating temperatures.

In the embodiments disclosed herein, certain motor types, pump types and material selections may be described. In other embodiments of the current disclosure as described in the claims, other torque input devices (motors), other fluid drivers (pumps), and other material combinations are contemplated. For example, metal materials may be described for their desired thermal expansion properties, but the current disclosure is not limited to metal materials, and any material appropriate for the components, the applications, and the thermal response desired may be used. As additional examples, plastics, polymers, ceramics, composites, or other materials may be employed. In some embodiments, one or more components may be made of a material that exhibits limited thermal expansion and the other components may be made of a material with thermal expansion characteristics tailored to achieve the desired outcomes. In other embodiments, the thermal expansion characteristics of the various components may be selected and balanced to achieve the outcomes that are desired. In some embodiments, the thermal expansion characteristics may be matched to achieve flat responses.

Referring to FIG. 1, a pump system 20 generally includes a motor 22 coupled with a pump 24. The motor 22 is a motive input device that imparts motion to parts of the pump 24 for its operation and in various embodiments, acts using electric power, pneumatic power, hydraulic power, mechanical power, or a combination thereof. The imparted motion may be rotary, linear, or otherwise configured. In the current embodiment, the motor 22 is electric and imparts a rotary torque to drive elements of the pump 24 through a shaft 26. The motor 22 may be a variety of types of electric motors and is one example is a brushless DC (BLDC) electric motor operated by a controller and power electronics 28, which may be separately or commonly housed. The size of the motor 22 drives the capacity of the power electronics 28 and therefor drives the cost and weight of the power electronics 28, Output power of the motor 22 may be specified in Watts, which varies according to speed of the motor, while output torque, such as in newton-meters is generally consistent over the operating speed of the motor. The amount of torque required to spin the pump 24 is a determining factor in the size and cost of the motor 22 and of its associated power electronics 28. Therefor, minimizing torque requirements of the pump system 20 is beneficial.

In general, the pump 24 operates to move fluid and/or to generate fluid pressure for any number of purposes. In the current embodiment, the pump 24 may be an internal gear-type pump and specifically is a gerotor pump. The moving parts include a rotor 30 (gerotor gear), fixed to the shaft 26 and an idler 32 within which the rotor 30 operates and which may also rotate. The moving parts including the idler 32 and the rotor 30 are contained in a housing 34 that includes a cover 36. The housing 34 defines a cavity 38 that contains the rotor 30 and the idler 32, and which is closed by the cover 36. The rotor 30 may generally float in a hydraulic film within the housing 34 created by the fluid being pumped. Faces 40, 42 of the rotor 30 comprise running faces and are pointed in opposite directions disposed parallel to the shaft 26. The face 40 is directed at (faces), a surface 44 in the housing cavity 38 and the face 42 is directed at (faces), a surface 46 of the cover 36.

Spaces or gaps may exist around the rotor 30, with one between the face 40 and the surface 44 and another between the face 42 and the surface 46. These two spaces/gaps may vary as the rotor 30 moves closer to the surface 44 or closer to the surface 46 and may be considered together as a datumized sum referred to collectively as a face clearance 50. The face clearance 50 is causal to various factors (performance characteristics), including torque to turn the rotor 30, which is provided by the motor 22, and to volumetric efficiency of the pump 24. The face clearance 50 may also apply to the idler 32. In a number of embodiments, the idler 32 may be a design factor in making the thermal expansion property selection, for optimized torque and volumetric efficiency requirements and the desired performance characteristic outcomes. The idler 32 has face clearances (as with rotor 30) and additionally an outer diameter face clearance 52 to the housing 34. The idler 32 thermal expansion relative to housing 34 may be a factor in the optimization. The idler 32 has face clearance properties and independent design freedom for material property and face clearance selection (multiple face clearances) to that of the rotor 30 yielding a possible third material thermal expansion characteristic. Another consideration may be an operating clearance between the rotor 30 and idler 32 as a variable for optimization of torque and volumetric efficiency.

An objective of the pump system 20 is to provide a combination of minimizing torque requirements, particularly at cold temperatures where the fluid being pumped may be most viscous, and maximizing volumetric efficiency, particularly at hot temperatures where the fluid being pumped may be least viscous. To provide the somewhat inconsistent combination, the pump 24 is designed to provide increased face clearance 50 at cold temperatures and decreased face clearance 50 at hot temperatures. The combination may be tuned with the objective of balancing the performance benefits by delivering a larger gap when less fluid resistance to rotation is desired, such as for lower torque requirements, and delivering a smaller gap when less internal fluid leakage is desired, such as for higher volumetric efficiency. As a result, lower pump, motor, and related costs are delivered along with higher pump system performance.

Figure 2:
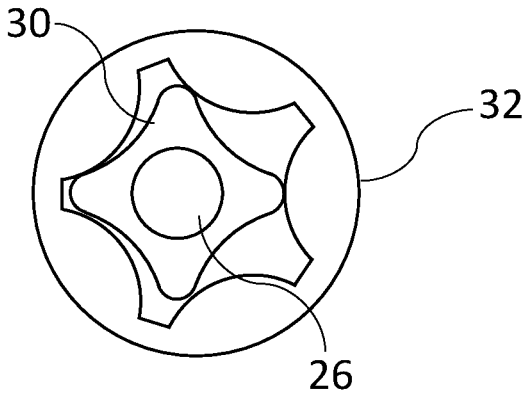
FIG. 2 is a detail illustration of a part of the pump system of FIG. 1, in accordance with various embodiments.
Figure 3:
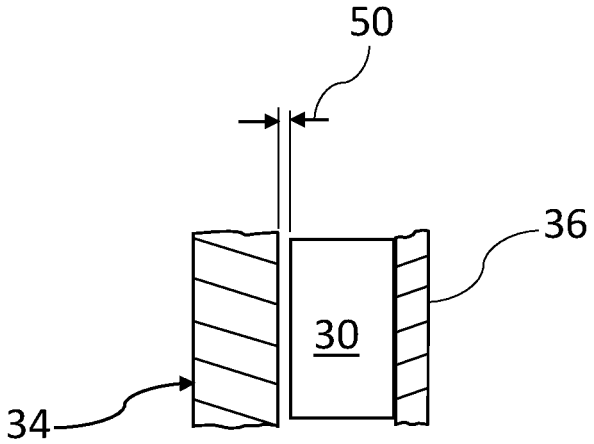
FIG. 3 is a schematic, detail illustration of a part of the pump system of FIG. 1 shown in a first state, in accordance with various embodiments.
Figure 4:
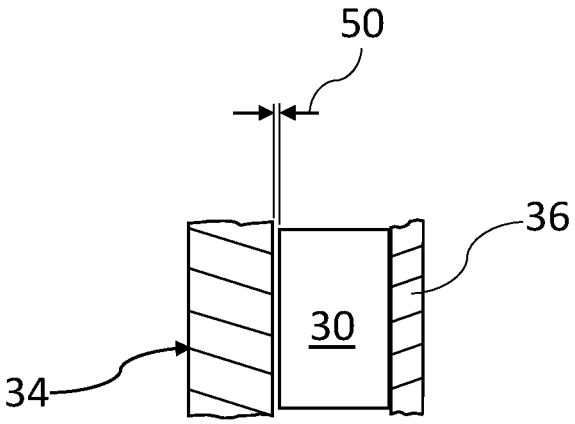
FIG. 4 is a schematic, detail illustration of the part of the pump system of FIG. 1 shown in a second state, in accordance with various embodiments.

Referring additionally to FIG. 2, the moving parts of the pump 24, and specifically the idler 32 and the rotor 30, are shown in isolation. As the rotor 30 turns on the shaft 26, suction and pressure areas are created between the rotor 30 and the idler 32 to pump fluid. During operation, the face clearance 50 may vary as shown in FIGS. 3 and 4. For example, at lower temperatures the face clearance 50 may be larger as shown in FIG. 3 and at higher temperatures the face clearance 50 may be smaller as shown in FIG. 4. This response is beneficially accomplished by the selection of materials used to make component parts such as the rotor 30 and the housing 34. For example, the rotor 30 and the housing 34 may be made of materials having coefficients of thermal expansion selected so that the rotor 30 expands more than the housing 34 to close the face clearance as temperatures increase. In other embodiments, the coefficients of thermal expansion may be tailored, factoring in the physical dimensions of the parts, so that the face clearance 50 remains constant as temperature changes. In other embodiments, various combinations of outcomes may be accomplished by tailoring the thermal expansions of the rotor 30 and of the housing 34 to target the magnitude of the face clearance 50 provided at temperatures of interest for the application. In other embodiments, the face clearance 50 and the outer diameter face clearance 52 of the idler 32 may be designed to tailor the thermal expansions at the temperatures of interest. In a number of embodiments, the thermal expansions may be tailored to achieve desired performance characteristic outcomes. In the current embodiment, the performance outcomes targeted include torque requirements and delivered volumetric efficiency. The two outcomes may be balanced by the selection of materials used and their coefficients of thermal expansion. One choice of materials to accomplish desirable results includes the use of steel to make the housing 34 and aluminum to make the rotor 30. The coefficient of thermal expansion of the resulting rotor 30 is approximately twice that of the housing 34 and as a result, the face clearance 50 closes as temperatures increase, and opens are temperature decrease. The idler 32 may be made of steel, aluminum, or any material to achieve the desired thermal and performance characteristics.

Figure 5:
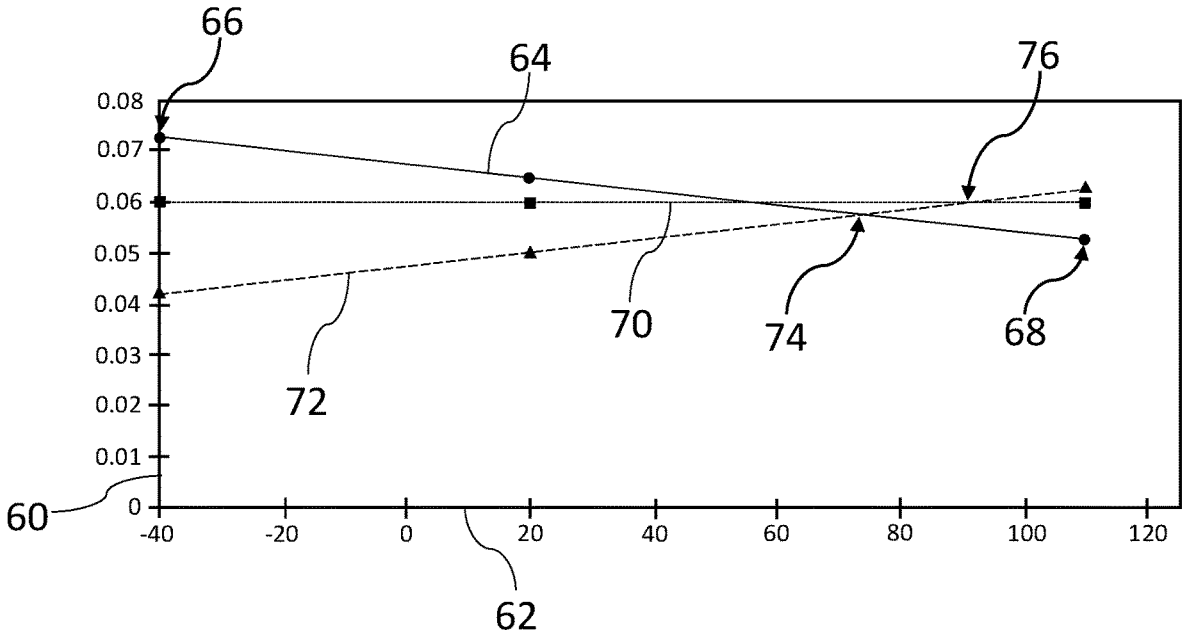
FIG. 5 is a graph of face clearance in millimeters versus temperature in degrees Celsius for the pump system of FIG. 1, in accordance with various embodiments.

As shown in FIG. 5, a graph depicts the face clearance 50 of the pump system 20 on the vertical axis 60 in millimeters versus temperature on the horizontal axis 62 in degrees Celsius. In various embodiments, the temperatures are those to which the pump system 20 is exposed and may be a result of a number of factors. For example, following a cold-soak where the pump system 20 has been idle in cold environmental conditions, the temperature is a result of the ambient temperature. Also for example, where the pump system 20 has been operating in hot environmental conditions the temperature is a result of the ambient temperature and may also be a result of temperature increases due to working of the fluid being pumped. For the current embodiment, the temperatures of interest are those to which the housing 34 and the rotor 30 are exposed.

Curve 64 depicts the pump system 20 with a response to achieve low cold temperature torque for minimizing the size of the motor 22 and to achieve high hot temperature volumetric efficiency for minimizing the capacity/size of the pump 24. Specifically, at approximately minus-forty degrees Celsius, the relative thermal expansion of the housing 34 and the rotor 30 is tailored to achieve a face clearance 50 of approximately 0.073 millimeters at the point 66. At approximately one-hundred-ten degrees Celsius, the relative thermal expansion of the housing 34 and the rotor 30 is tailored to achieve a face clearance 50 of approximately 0.053 millimeters at the point 68. This outcome may be accomplished, for example, by making the housing 34 of steel and making the rotor 30 of aluminum. In a number of embodiments, the design/material selections of the parts will move the curve 64 vertically, and the materials may be tuned to change the slope of the curve 64. For example, the size of the face clearance 50 may be increased or decreased across the temperature range by means of the selection of materials for the component parts.

Curve 70 depicts the pump system 20 with a response to achieve a constant face clearance 50, regardless of temperature. Specifically, at approximately minus-forty degrees Celsius, the relative thermal expansion of the housing 34 and the rotor 30 is tailored to achieve a face clearance 50 of approximately 0.060 millimeters. At approximately one-hundred-ten degrees Celsius, the relative thermal expansion of the housing 34 and the rotor 30 is tailored to achieve a face clearance 50 of approximately 0.060 millimeters. This outcome may be accomplished, for example, by making the housing 34 of steel and making the rotor 30 of steel. In some embodiments, the alloy composition of the steel may be tuned to achieve the flat response.

Curve 72 depicts the pump system 20 with a response, for comparison purposes, that shows the results of material selection. For example, if the rotor 30 is made of steel and the housing 34 is made of aluminum, the effect of temperature change is opposite that of the curve 64. Specifically, at minus-forty degrees Celsius, the relative thermal expansion of the housing 34 and the rotor 30 is tailored to achieve a face clearance 50 of approximately 0.042 millimeters. At one-hundred-ten degrees Celsius, the relative thermal expansion of the housing 34 and the rotor 30 is tailored to achieve a face clearance 50 of approximately 0.062 millimeters.

The curves 64 and 72 intersect at point 74, which is at approximately seventy-five degrees Celsius. At point 74 the performance of the pump system 20 is the same regardless of whether the rotor 30 is aluminum and the housing 34 is steel or the rotor 30 is steel and the housing 34 is aluminum. The curves 64, 70 intersect at the point 76, which is at approximately ninety degrees Celsius.

Figure 6:
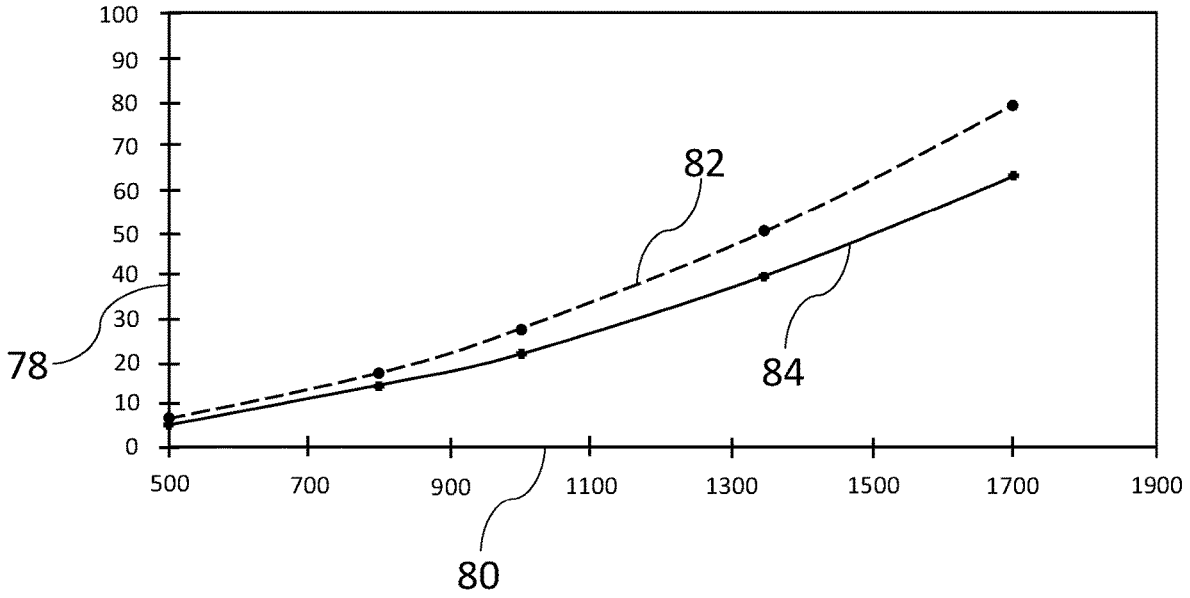
FIG. 6 is a graph of input powers in Watts versus speeds in revolutions per minute for the pump system of FIG. 1 and for a comparison examples, in accordance with various embodiments.

Referring to FIG. 6, a graph of power in Watts is depicted on the vertical axis 78 versus speed of the rotor 30 in revolutions per minute on the horizontal axis 80. The graph depicts an example of the pump system 20 with a steel housing 34 and a steel rotor 30 by the curve 82 and the pump system 20 with a steel housing 34 and an aluminum rotor 30 at the curve 84. Both curves 82 and 84 demonstrate power requirements at twenty degrees Celsius temperature. As shown, the curve 84 results in up to a twenty-one percent reduction in power requirements, achieved by tailoring the materials used for their thermal response characteristics.

Figure 7:
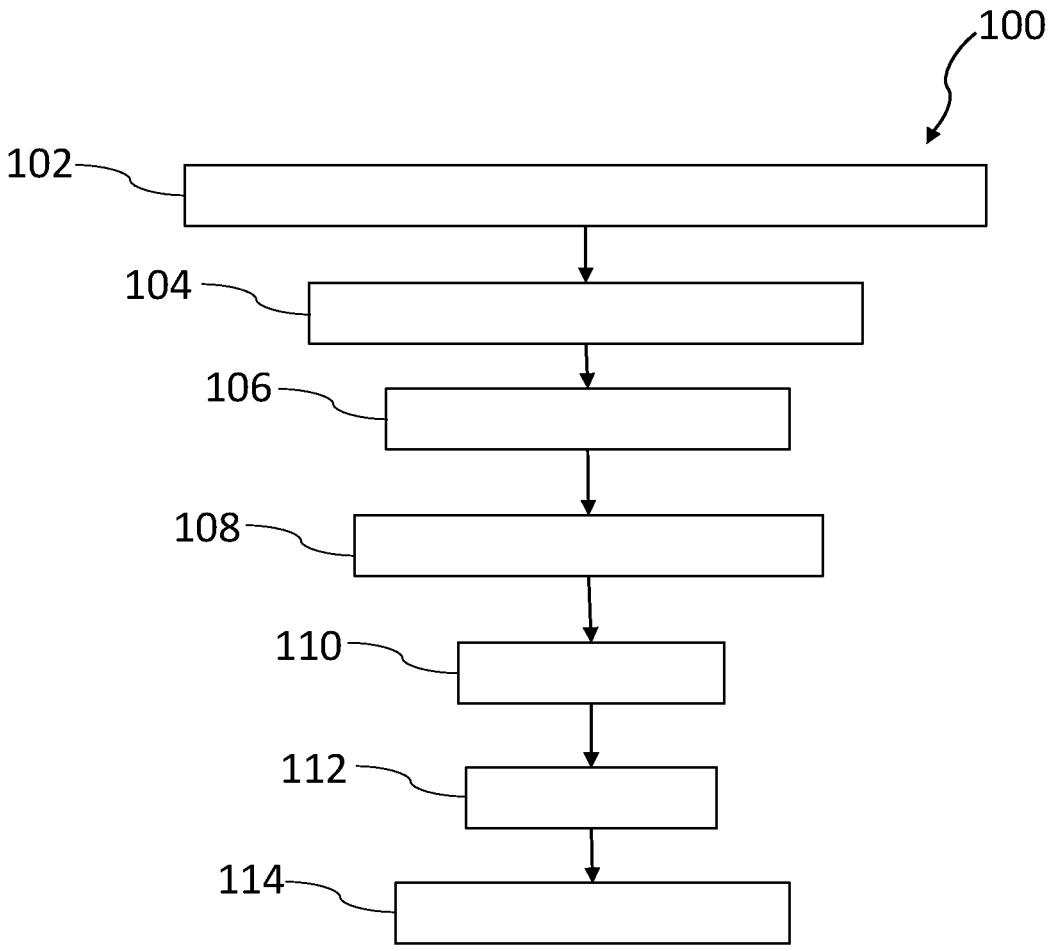
FIG. 7 illustrates a method of constructing the pump system of FIG. 1, in accordance with various embodiments.

A process 100 for constructing a pump system, such as to optimize torque requirements and volumetric efficiencies of the pump system 20, is depicted in FIG. 7 in flowchart form, to which reference is directed. The temperatures at which the pump system 20 will operate are determined 102. The targets for the pump system are determined 104. For example, the temperatures at which minimizing the power required of the motor 22 are determined and the temperatures at which the volumetric efficiency of the pump 24 is maximized are determined. In the case of a vehicle application, the temperatures of interest may be between minus-forty and one-hundred-twenty-five degrees Celsius. Specific temperature of interest may be minus forty and one-hundred-ten degrees Celsius. The size of the face clearance 50 and/or of the outer diameter face clearance 52 to achieve the targets determined 102 are calculated 106. For example, the pump system 20 may be modeled using commercially available fluid dynamics modeling software, or other calculations may be employed. Alternatively, physical modeling and testing may be conducted. The materials, such as for the housing 34, the rotor 30, and the idler 32, and their coefficients of thermal expansion are considered 106. For example, various materials may be considered 106, with their performances modeled via software and/or physically. From the materials considered 106, a selection 110 is made to achieve the calculated 106 face clearances 50 and/or 52 at the target temperatures that were determined 104. Next, any needed tuning 112 is undertaken to adjust the performance of the pump system 20, such as to achieve desired torque requirements and/or volumetric efficiencies at temperatures of interest. The pump system 20 is then constructed 114 using the selected materials for the rotor 30, the idler 32, and the housing 34 that achieve the desired results. In a number of embodiments, the order of the steps in the process 100 may differ from those described herein, other steps may be added, and some steps may be omitted.

Accordingly, pump systems and methods are provided where torque requirements are minimized at low temperature operating conditions and volumetric efficiency is maximized at high temperature operating conditions. While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A pump of a rotating element type, the pump comprising:

a housing defining a surface; and a rotor defining a face, with a face clearance defined between the face and the surface, the face clearance variable in magnitude and determinative of target performance characteristics of the pump system, wherein the housing comprises a steel material selected to have a first thermal expansion characteristic, wherein the rotor comprises an aluminum material selected to have a second thermal expansion characteristic, wherein the first thermal expansion characteristic and the second thermal expansion characteristic comprise greater expansion of the rotor than the housing in response to temperature increases, wherein the first thermal expansion characteristic and the second thermal expansion characteristic deliver the target performance characteristics of the pump.

2. The pump of claim 1, wherein the rotor is configured to rotate on an axis, wherein the face of the rotor faces in a direction parallel to the axis.

3. The pump of claim 2, wherein the first thermal expansion characteristic and the second thermal expansion characteristic result in opening the face clearance as temperature decreases and closing the face clearance as temperature increases.

4. The pump system of claim 1, wherein the first thermal expansion characteristic and the second thermal expansion characteristic are configured to manage the face clearance to minimize energy input and consumption needed to drive the pump as temperature decrease.

5. The pump of claim 1, wherein the first thermal expansion characteristic and the second thermal expansion characteristic comprise matched expansion of the rotor and the housing in response to temperature increases to maintain the face clearance at a consistent value.

6. The pump of claim 1, comprising a motor coupled with the rotor, wherein the first thermal expansion characteristic and the second thermal expansion characteristic comprise targeted increase of the face clearance as temperature decreases to minimize torque requirements of the motor.

7. The pump of claim 1, wherein the first thermal expansion characteristic and the second thermal expansion characteristic comprise targeted maximization of the volumetric efficiency of the pump as temperature increases.

8. The pump of claim 1, comprising an electric motor coupled with the rotor, and power electronics coupled with the electric motor, wherein the first thermal expansion characteristic and the second thermal expansion characteristic are selected to minimize size of the electric motor.

9. The pump of claim 1, wherein the rotor comprises a gerotor, and comprising an idler surrounding the gerotor.

10. The pump of claim 1, wherein:

the housing defines a cavity, with the rotor disposed in the cavity, the cavity is closed by a cover defining a second surface, the rotor includes the face facing the surface of the housing and includes a second face facing the second surface, a first gap is defined between the face of the rotor and the surface of the housing, a second gap is defined between the second face of the rotor and the second surface of the housing, and the face clearance comprises a sum of the first gap and the second gap.

11. A method comprising:

constructing a pump with a housing defining a surface;

assembling a rotor in the pump, with the rotor defining a face, and defining a face clearance between the face of the rotor and the surface of the housing, with the face clearance variable in magnitude;

coupling an electric motor with the rotor;

coupling power electronics with the electric motor;

determining, based on the face clearance, target performance characteristics of the pump, selecting, for the housing, a first material having a first thermal expansion characteristic;

selecting, for the rotor, a second material selected to have a second thermal expansion characteristic;

selecting the first thermal expansion characteristic and the second thermal expansion characteristic to minimize size of the electric motor; and delivering, by the first thermal expansion characteristic and the second thermal expansion characteristic, the target performance characteristics of the pump system.

12. The method of claim 11, comprising, delivering, based on the first thermal expansion characteristic and the second thermal expansion characteristic, a greater expansion of the rotor than the housing in response to temperature increases.

13. The method of claim 12, comprising selecting steel as the first material and aluminum as the second material.

14. The method of claim 12, comprising:

opening, based on the first thermal expansion characteristic and the second thermal expansion characteristic, the face clearance as temperature decreases; and closing, based on the first thermal expansion characteristic and the second thermal expansion characteristic, the face clearance as temperature increases.

15. The method of claim 11, comprising matching, based on the first thermal expansion characteristic and the second thermal expansion characteristic, expansion of the rotor and the housing in response to temperature increases, maintaining the face clearance at a consistent value.

16. The method of claim 11, comprising:

targeting, based on the first thermal expansion characteristic and the second thermal expansion characteristic, increase of the face clearance as temperature decreases to minimize torque requirements of the motor.

17. The method of claim 11, comprising targeting, based on the first thermal expansion characteristic and the second thermal expansion characteristic, maximization of the volumetric efficiency of the pump as temperature increases.

18. The method of claim 11, comprising:

selecting the first material and the second material so that the face clearance increases as temperature decreases.

19. The method of claim 11, comprising:

considering a range of materials to deliver the target performance characteristics;

selecting the materials that deliver minimized torque requirements at lowered temperatures and maximized volumetric efficiency at increased temperatures; and tuning the selected materials by altering their thermal expansion characteristics to deliver a desired magnitude of the face clearance at select temperatures.

20. A pump comprising:

a housing defining a surface;

a rotor defining a face, with a face clearance defined between the face of the rotor and the surface of the housing, the face clearance variable in magnitude and determinative of target performance characteristics of the pump;

an electric motor coupled with the rotor; and power electronics coupled with the electric motor, wherein the housing comprises a first material selected to have a first thermal expansion characteristic, wherein the rotor comprises a second material selected to have a second thermal expansion characteristic, wherein the first thermal expansion characteristic and the second thermal expansion characteristic are selected to minimize size of the electric motor, wherein the first thermal expansion characteristic and the second thermal expansion characteristic deliver greater expansion of the rotor as compared to the housing under increasing temperature to deliver minimized torque requirements of the motor at decreasing temperature and maximized volumetric efficiency of the pump under increasing temperature.

* * * * *